US006786591B2

(12) United States Patent
Dunfield et al.

(10) Patent No.: US 6,786,591 B2
(45) Date of Patent: Sep. 7, 2004

(54) FLUID EJECTOR APPARATUS AND METHODS

(75) Inventors: John Stephen Dunfield, Corvallis, OR (US); James W. Ayers, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/281,007

(22) Filed: Oct. 24, 2002

(65) Prior Publication Data

US 2004/0080578 A1 Apr. 29, 2004

(51) Int. Cl.[7] ..... B41J 29/38; B41J 3/407; B41J 23/00; B41F 17/00

(52) U.S. Cl. ..... 347/106; 347/16; 347/38; 101/35

(58) Field of Search ..... 347/1, 104, 108, 347/16, 7, 37, 38; 400/88; 101/34, 35

(56) References Cited

U.S. PATENT DOCUMENTS

| | | | | |
|---|---|---|---|---|
| 4,069,084 A | | 1/1978 | Mlodozeniec et al. | |
| 4,197,289 A | | 4/1980 | Sturzenegger et al. | |
| 4,304,179 A | * | 12/1981 | Katou et al. | 101/34 |
| 4,322,449 A | | 3/1982 | Voss et al. | |
| 4,548,825 A | | 10/1985 | Voss et al. | |
| 4,682,182 A | | 7/1987 | Oyama et al. | |
| 4,905,589 A | | 3/1990 | Ackley | |
| 5,023,625 A | | 6/1991 | Bares et al. | |
| 5,083,137 A | * | 1/1992 | Badyal et al. | 347/14 |
| 5,119,109 A | | 6/1992 | Robertson | |
| 5,512,925 A | * | 4/1996 | Ohashi | 347/86 |
| 5,609,908 A | | 3/1997 | Voss | |
| 5,699,091 A | * | 12/1997 | Bullock et al. | 347/19 |
| 5,714,007 A | | 2/1998 | Pletcher et al. | |
| 5,771,050 A | * | 6/1998 | Gielen | 347/19 |
| 5,881,716 A | | 3/1999 | Wirch et al. | |
| 5,925,732 A | | 7/1999 | Ecker et al. | |
| 6,033,053 A | * | 3/2000 | Eun | 347/38 |
| 6,086,942 A | | 7/2000 | Carden, Jr. et al. | |
| 6,143,353 A | | 11/2000 | Oshlack et al. | |
| 6,409,316 B1 | * | 6/2002 | Clark et al. | 347/63 |
| 6,615,690 B2 | * | 9/2003 | Chen | 74/280 |
| 2001/0003871 A1 | | 6/2001 | Patton et al. | |
| 2002/0121529 A1 | | 9/2002 | Hoummady | |

FOREIGN PATENT DOCUMENTS

| | | | |
|---|---|---|---|
| JP | 61-213154 | * 12/1986 | 101/35 |

* cited by examiner

*Primary Examiner*—Michael S. Brooke
(74) *Attorney, Agent, or Firm*—Donald J. Coulman

(57) ABSTRACT

A fluid ejector head, includes a fluid ejector body adapted to be inserted into an opening of an enclosing medium having an interior surface, and at least one nozzle disposed on the fluid ejector body. The fluid ejector head further includes, a fluid ejector actuator in fluid communication with the at least one nozzle, wherein activation of the fluid ejector actuator ejects a fluid through the at least one nozzle at controlled locations onto the interior surface of the enclosing medium.

60 Claims, 13 Drawing Sheets

FLUID EJECTOR APPARATUS AND METHODS

BACKGROUND

Description of the Art

Over the past decade, substantial developments have been made in the micro-manipulation of fluids in fields such as electronic printing technology using inkjet printers. Currently there is a wide variety of highly-efficient inkjet printing systems in use, which are capable of dispensing ink in a rapid and accurate manner onto paper sheets or other relatively flat media such as envelopes or labels.

Typically, an inkjet printing system utilizes a platen to which a paper sheet or other relatively flat and flexible medium is transported by friction utilizing various motors, gears, wheels, shafts and mounts. This medium transport mechanism, typically, provides the movement enabling the medium to be acquired from a tray and then advanced through a print zone by pushing, pulling, or carrying the medium. The print zone typically locates the medium relative to the printhead. A nearly flat print zone is, typically, utilized because the two-dimensional extent of typical nozzle layouts would result in varying firing distances if the medium or medium support has to much curvature. A carriage holding one or more print cartridges, having one or more fluid ejector heads, is, typically, supported by a slide bar, or similar mechanism within the system, and physically propelled along the slide bar to allow the carriage to be translationally reciprocated or scanned back and forth across the medium. When a swath of ink dots has been completed, the medium is moved an appropriate distance along the medium sheet axis, in preparation for the next swath.

The ability, to utilize fluid ejectors and fluid dispensing systems, to dispense discrete deposits of a material onto the surface of media of various shapes and flexibility, in specified locations, would open up a wide variety of applications that are currently impractical.

DESCRIPTION OF THE PREFERRED EMBODIMENTS

Figure 1A:
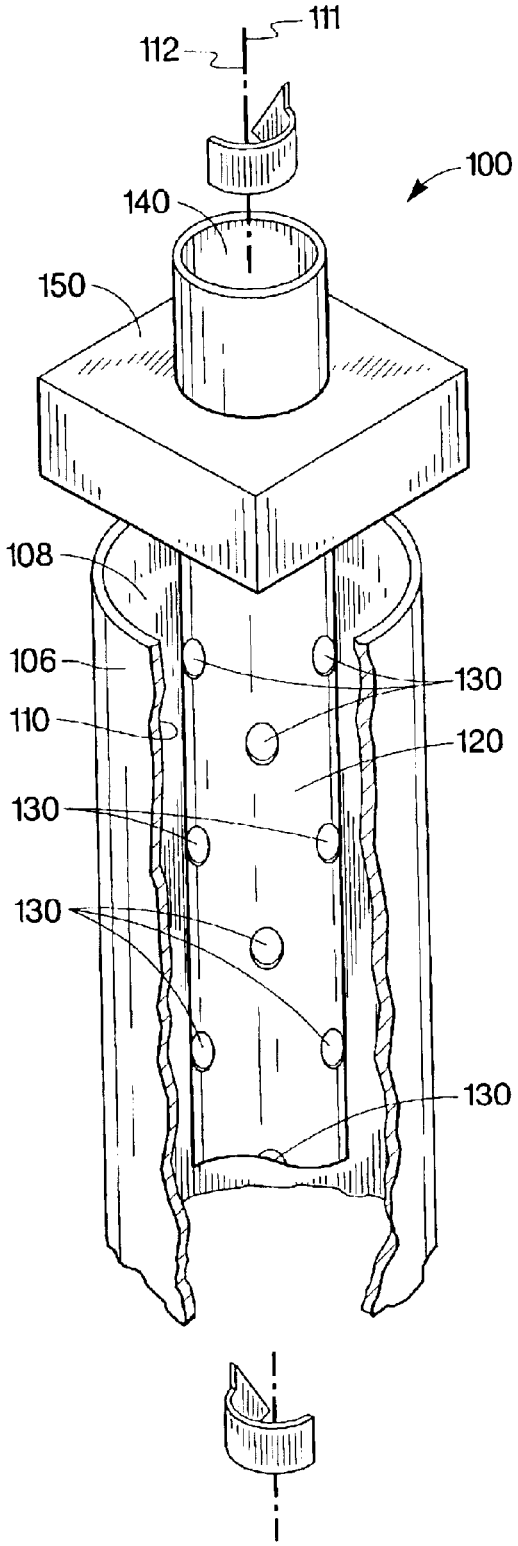
FIG. 1*a* is a perspective view of a fluid ejector head according to an embodiment of the present invention.

Referring to FIG. 1*a*, an embodiment of the present invention is shown in a perspective view. In this embodiment, fluid ejector head 100 includes fluid ejector body 120 adapted to be inserted into enclosing medium opening 108. Fluid ejector head 100 further includes nozzles 130 disposed on fluid ejector body 120 and fluidically coupled to fluid channel 140. Fluid ejector actuator 150 is in fluid communication with nozzles 130. Activation of fluid ejector actuator 150 ejects a fluid onto a predetermined location onto interior surface 110 of enclosing medium 106.

Figure 1B:
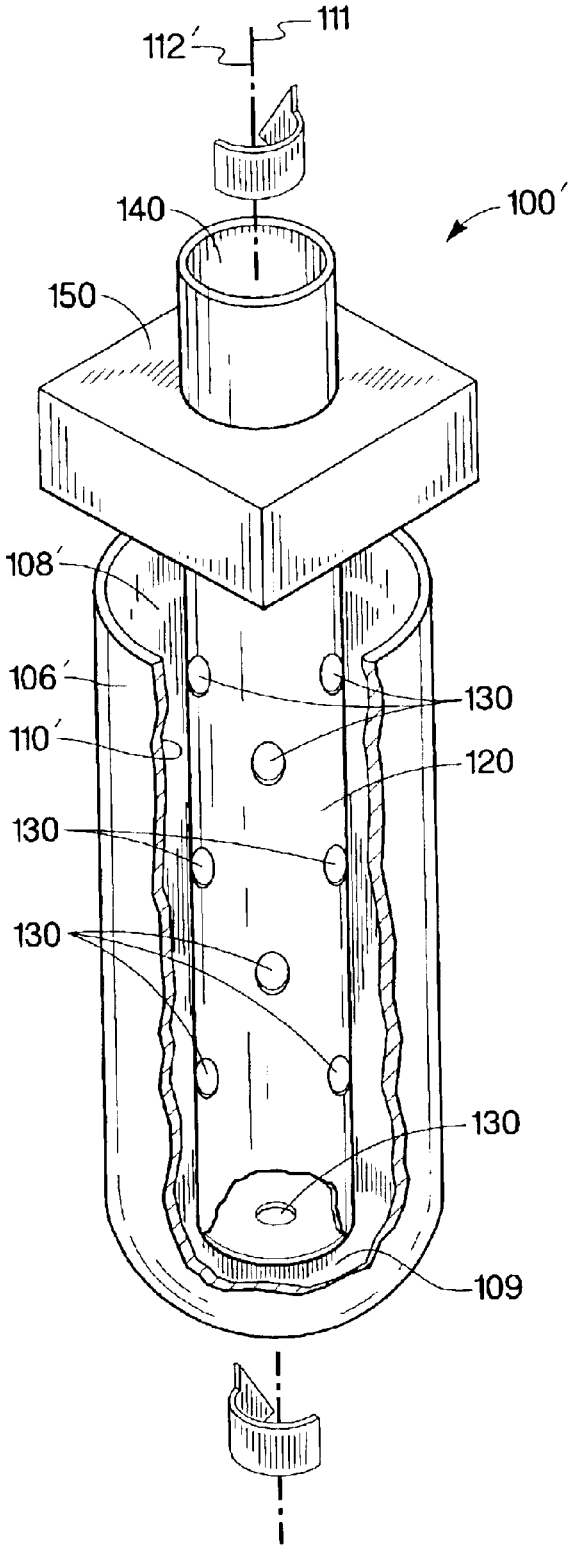
FIG. 1*b* is a perspective view of a fluid ejector head according to an alternate embodiment of the present invention.

For purposes of this description and the present invention, the term enclosing medium may be any solid or semi-solid material object with a shape, having a substantially fixed form, including an inside, or interior, surface and an outer, or exterior, surface. The term substantially fixed form is used to imply permanence of the interior surface of the object not of the shape of the object. For example, a bag may change shape depending on whether it is open or closed, however, the existence of the interior surface remains whether open or closed. In addition, the substantially fixed form also includes at least one opening having a cross-sectional area less than the maximum cross-sectional area obtainable for that shape. The enclosing medium may have rectangular parallelepiped, cylindrical, ellipsoidal, or spherical shapes just to name a few simple geometric shapes that may be utilized. For example, enclosing medium 106 may be a vial, a bottle, a capsule, a box, a bag, or a tube to name a few articles that may be utilized. In alternate embodiments, as shown in FIG. 1*b*, enclosing medium 106 may include a bottom surface such as a vial or gelatin capsule. In addition fluid ejector head 100' may also include nozzles providing ejection of the fluid onto bottom interior surface 109, as well as the side interior surface 110', of the capsule as shown in FIG. 1*b*.

In this embodiment fluid ejector body 120 includes multiple bores or nozzles 130, the actual number shown in FIGS. 1*a* and 1*b* is for illustrative purposes only. The number of nozzles utilized depends on various parameters such as the particular fluid or fluids to be dispensed, the particular deposits to be generated, and the particular size of the enclosing medium utilized. In this embodiment, either fluid ejector body 120 or enclosing medium 106 or both are rotatable about the longitudinal axis 112 of enclosing medium 106 providing the ability to dispense fluid in a two-dimensional array on the interior surface of the enclosing medium. Fluid ejector head 100 provides control of fluid deposits by dispensing the fluid in discrete amounts on the inside of an enclosing medium in a controlled manner.

It should be noted that the drawings are not true to scale. Further, various elements have not been drawn to scale. Certain dimensions have been exaggerated in relation to other dimensions in order to provide a clearer illustration and understanding of the present invention.

In addition, although some of the embodiments illustrated herein are shown in two dimensional views with various regions having depth and width, it should be clearly understood that these regions are illustrations of only a portion of a device that is actually a three dimensional structure. Accordingly, these regions will have three dimensions, including length, width, and depth, when fabricated on an actual device. Moreover, while the present invention is illustrated by various embodiments, it is not intended that these illustrations be a limitation on the scope or applicability of the present invention. Further it is not intended that the embodiments of the present invention be limited to the physical structures illustrated. These structures are included to demonstrate the utility and application of the present invention to presently preferred embodiments.

Fluid ejector body 120, in this embodiment, is a tubular shaped structure having an outside diameter less than the inside diameter of enclosing medium opening 108, such that fluid ejector body 120 is insertable into enclosing medium opening 108, along longitudinal axis 112, of enclosing medium 106. In this embodiment, fluid ejector body 120 also includes a fluid ejector body longitudinal axis 111 that is aligned with longitudinal axis 112 of enclosing medium 106. In alternate embodiments, depending on various parameters such as the shape of the enclosing medium and the fluid ejector body, the fluid ejector body longitudinal axis may not be in alignment with the longitudinal axis of the enclosing medium. Fluid ejector body 120 may utilize any ceramic, metal, or plastic material capable of forming the appropriate sized tubular shape. Fluid ejector actuator 150 may be any device capable of imparting sufficient energy to the fluid either in fluid channel 140 or in close proximity to nozzles 130. For example, compressed air actuators, such as utilized in an airbrush, or electro-mechanical actuators or thermal mechanical actuators may be utilized to eject the fluid from nozzles 130.

Figure 2A:
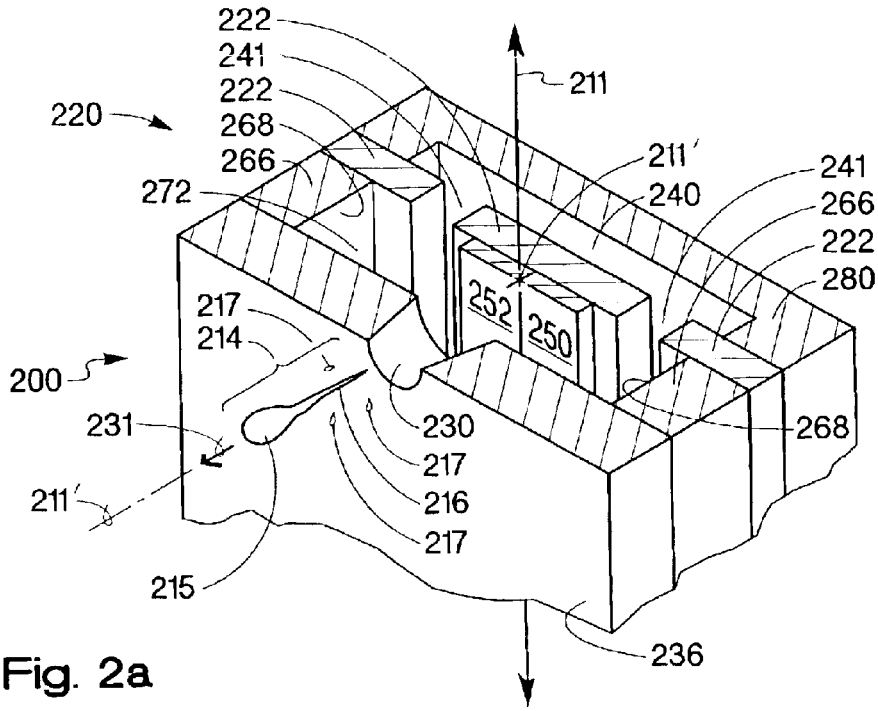
FIG. 2*a* is an isometric cross-sectional view of a fluid ejector body according to an alternate embodiment of the present invention.

An exemplary embodiment of a fluid ejector head is shown in an isometric cross-sectional view in FIG. 2*a*. In this embodiment, fluid ejector head 200 includes fluid ejector body 220 wherein at least a portion of the body has a rectangular cross-section. In alternate embodiments, fluid ejector body may have a parallelepiped structure. In addition, fluid ejector body 220 also includes fluid body longitudinal axis 211 projecting in and out of the cross sectional view. Fluid ejector body 220 is adapted to be inserted into an opening of an enclosing medium and is rotatable within the enclosing medium. In addition, nozzle 230 has an ejection axis 231 defining the general direction in which drops are ejected from fluid ejector body 220. Fluid body longitudinal axis 211 and nozzle ejection axis 231 form predetermined ejection angle 218 (see FIG. 2*b*). In this embodiment, nozzle ejection axis 231 may be aligned at an angle between 0° and 60° degrees from fluid body normal 211' of fluid body longitudinal axis 211 as shown in a perspective view in FIG. 2*b*. In alternate embodiments, nozzle ejection axis 232 is aligned at an angle between 0° and 45°, and more preferably nozzle ejection axis 232 is substantially perpendicular to fluid body longitudinal axis 211. In addition, ejection angles 231' and 231" illustrate that the angle may be either in a positive or in a negative direction relative to fluid body normal 211'.

Fluid ejector head 200 further includes fluid ejector actuator 250, chamber layer 266, fluid body housing 280, and nozzle layer 236. In this embodiment, substrate 222 is a portion of a silicon wafer. In alternate embodiments, other materials may also be utilized for substrate 222, such as, various glasses, aluminum oxide, polyimide substrates, silicon carbide, and gallium arsenide. Accordingly, the present invention is not intended to be limited to those devices fabricated in silicon semiconductor materials. In this embodiment, fluid body housing 280 and substrate 222 form fluid channel 240. Fluid inlet channels 241 are formed in substrate 222, and provide fluidic coupling between fluid channel 240 and fluid ejection chamber 272.

Fluid energy generating element 252 is disposed on substrate 222 and provides the energy impulse utilized to eject fluid from nozzle 230. As described above, fluid ejector actuator 250 may be any element capable of imparting sufficient energy to the fluid to eject it from nozzle 230. In this embodiment, fluid ejector actuator 250 includes fluid energy generating element 252, which is a thermal resistor. In alternate embodiments, other fluid energy generating elements such as piezoelectric, flex-tensional, acoustic, and electrostatic generators may also be utilized. For example, a piezoelectric element utilizes a voltage pulse to generate a compressive force on the fluid resulting in ejection of a drop of the fluid. In still other embodiments, fluid energy generating element 252 may be located some distance away, in a lateral direction, from nozzle 230. The particular distance will depend on various parameters such as the particular fluid being dispensed, the particular structure of chamber 272, and the structure and size of fluid channel 240, to name a few parameters.

The thermal resistor is typically formed as a tantalum aluminum alloy utilizing conventional semiconductor processing equipment. In alternate embodiments, other resistor alloys may be utilized such as tungsten silicon nitride, or polysilicon. The thermal resistor typically is connected to electrical inputs by way of metallization (not shown) on the surface of substrate 222. Additionally, various layers of protection from chemical and mechanical attack may be placed over the thermal resistor, but are not shown in FIG. 2 for clarity. Substrate 222 also includes, in this embodiment, active devices such as one or more transistors (not shown for clarity) electrically coupled to fluid energy generating element 252. In alternate embodiments, other active devices such as diodes or memory logic cells may also be utilized, either separately or in combination with the one or more transistors. In still other embodiments, what is commonly referred to as a "direct drive" fluid ejector head, where substrate 222 may include fluid ejector generators without active devices, may also be utilized. The particular combination of active devices and fluid energy generating elements will depend on various parameters such as the particular application in which fluid ejector head 200 is used, and the particular fluid being ejected to name a couple of parameters.

In this embodiment, an energy impulse applied across the thermal resistor rapidly heats a component in the fluid above its boiling point causing vaporization of the fluid component resulting in an expanding bubble that ejects fluid drop 214 as shown in FIG. 2*a*. Fluid drop 214 typically includes droplet head 215, drop-tail 216 and satellite-drops 217, which may be characterized as essentially a fluid drop. In this embodiment, each activation of energy generating element 252 results in the ejection of a precise quantity of fluid in the form of essentially a fluid drop; thus, the number of times the fluid energy generating element is activated controls the number of drops 214 ejected from nozzle 230 (i.e. n activations results in essentially n fluid drops). Thus, fluid ejector head 200 may generate deposits of discrete droplets of a fluid, including a solid material dissolved in one or more solvents or suspended or dispersed in the fluid, onto a discrete predetermined location on the interior surface of an enclosing substrate.

The drop volume of fluid drop 214 may be optimized by various parameters such as nozzle bore diameter, nozzle layer thickness, chamber dimensions, chamber layer thickness, energy generating element dimensions, and the fluid surface tension to name a few. Thus, the drop volume can be optimized for the particular fluid being ejected as well as the particular application in which the enclosing medium will be utilized. Fluid ejector head 200 described in this embodiment can reproducibly and reliably eject drops in the range of from about five femtoliters to about 10 nanoliters depending on the parameters and structures of the fluid ejector head as described above. In alternate embodiments, fluid ejector head 200 can eject drops in the range from about 5 femtoliters to about 1 microliter. In addition, according to other embodiments, multiple fluid ejector heads 200 may be ganged together to form polygonal structures. For example, two fluid ejector heads 200 may be formed back to back providing the ability to dispense two different fluids so that, one set of fluid ejector heads may dispense ink, and another set of fluid ejector heads may dispense a sealant or protective material to cover or coat the dispensed ink. A second example, utilizes multiple sets of fluid ejector heads to eject multiple different fluids such as color inks with or without the use of a sealant or protective material. The term fluid includes any fluid material such as inks, adhesives, lubricants, chemical or biological reagents, as well as fluids containing dissolved or dispersed solids in one or more solvents. Further, fluid ejector head 200 may also contain a fluid that is a mixture of materials providing multiple functions and thus various combinations are possible, such as one set of fluid ejector heads ejecting an ink and protective material mixed together, and another set ejecting just an ink.

Figure 2B:
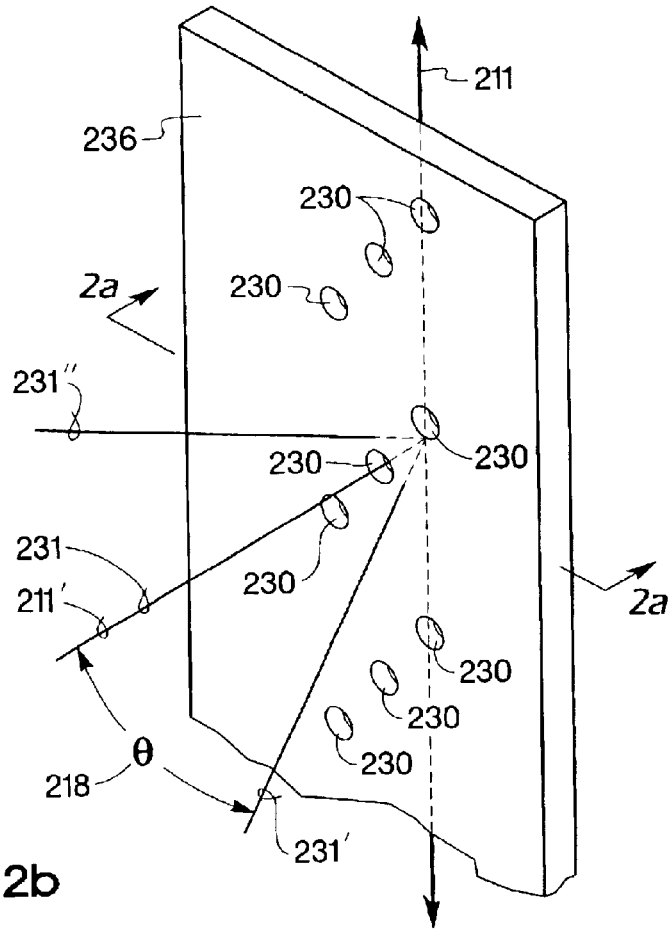
FIG. 2*b* is a perspective view of a portion of the fluid ejector body shown in FIG. 2*a* according to an embodiment of the present invention.

Chamber layer 266 is selectively disposed over the surface of substrate 222. Sidewalls 268 define or form fluid ejection chamber 272, around energy generating element 252, so that fluid, from fluid channel 240 via fluid inlet channels 241, may accumulate in fluid ejection chamber 272 prior to activation of energy generating element 252 and expulsion of fluid through nozzle or orifice 230 when energy generating element 252 is activated. Nozzle or orifice layer 236 is disposed over chamber layer 266 and includes one or more bores or nozzles 230 through which fluid is ejected. In alternate embodiments, depending on the particular materials utilized for chamber layer 266 and nozzle layer 236, an adhesive layer (not shown) may also be utilized to adhere nozzle layer 236 to chamber layer 266. According to additional embodiments, chamber layer 266 and nozzle layer 236 are formed as a single integrated chamber nozzle layer. Chamber layer 266, typically, is a photoimagible film that utilizes photolithography equipment to form chamber layer 266 on substrate 222 and then define and develop fluid ejection chamber 272. The nozzles formed along longitudinal axis 211 may be in a straight line or a staggered configuration depending on the particular application, in which fluid ejector head 200 is utilized, a staggered configuration is illustrated in FIG. 2*b*.

Nozzle layer 236 may be formed of metal, polymer, glass, or other suitable material such as ceramic. In this embodiment, nozzle layer 236 is a polyimide film. Examples of commercially available nozzle layer materials include a polyimide film available from E. I. DuPont de Nemours & Co. sold under the name "Kapton", a polyimide material available from Ube Industries, LTD (of Japan) sold under the name "Upilex." In an alternate embodiment, the nozzle layer 236 is formed from a metal such as a nickel base enclosed by a thin gold, palladium, tantalum, or rhodium layer. In other alternative embodiments, nozzle layer 236 may be formed from polymers such as polyester, polyethylene naphthalate (PEN), epoxy, or polycarbonate.

Figure 3:
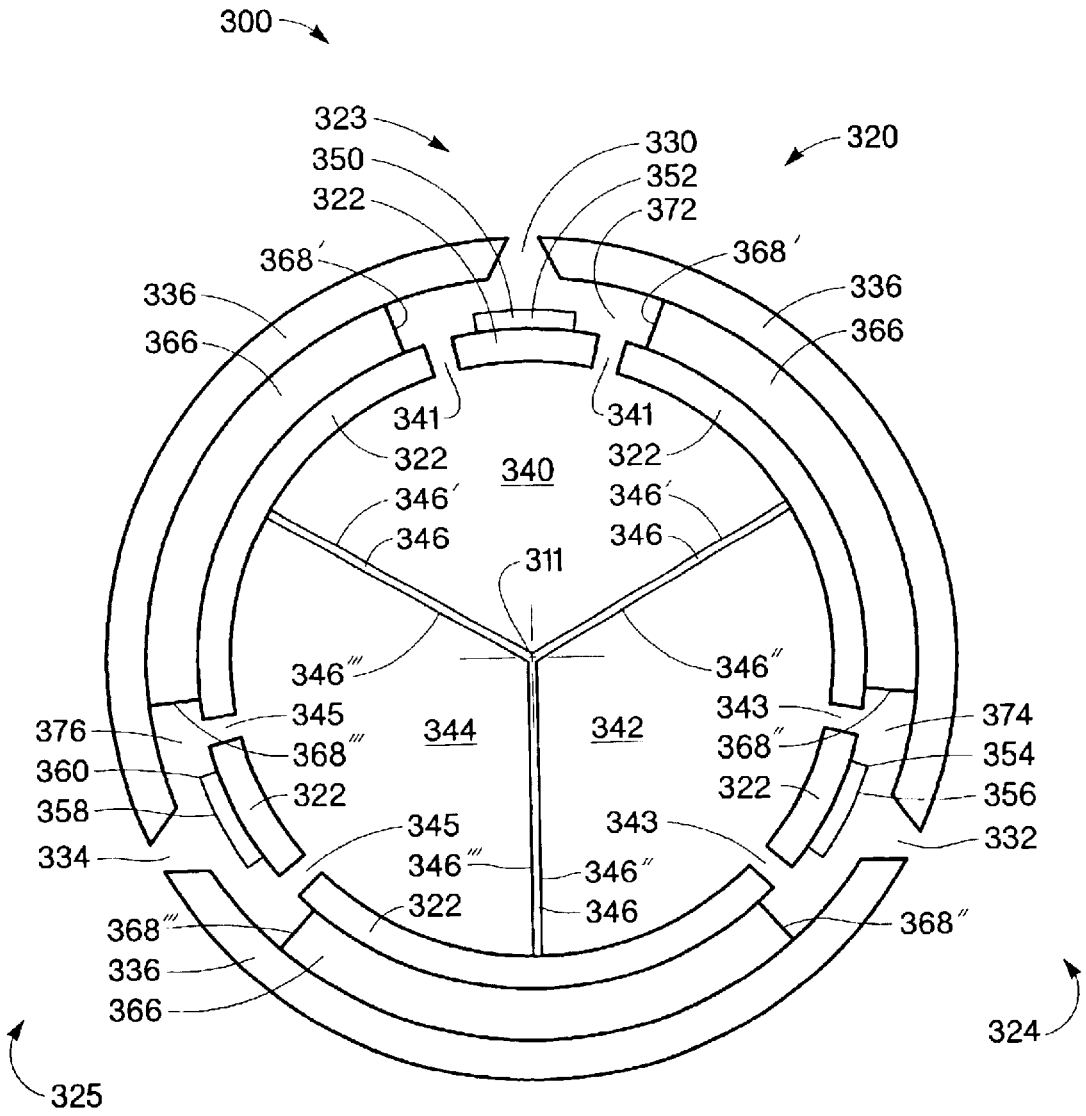
FIG. 3 is a cross-sectional view of a fluid ejector body according to an alternate embodiment of the present invention.

An alternate embodiment of a fluid ejector head is shown in a cross-sectional view in FIG. 3. In this embodiment, fluid ejector head 300 includes fluid ejector body 320, wherein at least a portion of the body has a cylindrical cross-sectional shape, including fluid body longitudinal axis 311 projecting in and out of the cross sectional view. In alternate embodiments, fluid ejector body 320 may have a portion having a curvilinear shape. Fluid ejector head 300 further includes fluid ejector actuator 350, second fluid ejector actuator 354, and third fluid ejector actuator 358 disposed on fluid ejector body 320. Although the fluid ejector actuators are disposed under the nozzles in this embodiment, in alternate embodiments, the fluid ejector actuators may be positioned some lateral distance away from the nozzles. The particular distance will depend on various parameters such as the particular fluid being dispensed, the particular structure of the chambers, and the structure and size of the fluid channels, to name a few parameters. Fluid channel separator 346 is attached to substrate 322 and separates fluid ejector head 300 into three sections: fluid section 323, second fluid section 324, and third fluid section 325. In this embodiment, fluid channel 340 is formed by fluid channel separator portions 346' and substrate 322; second fluid channel 342 is formed by fluid channel separator portions 346" and substrate 322; and third fluid channel 344 is formed by fluid channel separator portions 346''' and substrate 322.

Fluid inlet channels 341 provide fluidic coupling between fluid channel 340 and chamber 372, and are formed in substrate 322 within fluid section 323. Fluid inlet channels 343 and 345 provide fluidic coupling between fluid channels 342 and 344 and chambers 374 and 376 respectively. Fluid energy generating element 352 is disposed on substrate 322 and provides the energy impulse utilized to eject fluid from nozzle 330. Fluid energy generating elements 356 and 360 provide the energy impulses utilized to eject fluid from nozzles 332 and 334 respectively. In this embodiment, fluid energy generating elements 352, 356, and 360 are thermal resistors that rapidly heat a component in the fluid above its boiling point causing vaporization of the fluid component resulting in ejection of a drop of the fluid. In alternate embodiments, other fluid energy generating elements such as piezoelectric, flex-tensional, acoustic, and electrostatic generators may also be utilized. In this embodiment, fluid energy generating elements 352, 356, and 360 eject the fluid in a substantially radial direction onto the interior surface of the enclosing medium (not shown).

Chamber layer 366 is disposed over substrate 322 wherein sidewalls 368' define or form a portion of fluid ejection chamber 372 in fluid section 323; sidewalls 368" form a portion of second fluid ejection chamber 374 in second fluid section 324; and sidewalls 368''' for a portion of fluid ejection chamber 376 in third fluid section 325. Nozzle or orifice layer 336 is disposed over chamber layer 366 and includes one or more bores or nozzles 330, 332, and 334 through which fluid in the three sections is ejected. In alternate embodiments, depending on the particular materials utilized for chamber layer 366 and nozzle layer 336, an adhesive layer may also be utilized to adhere nozzle layer 336 to chamber layer 366. According to additional embodiments, chamber layer 366 and nozzle layer 336 are formed as a single layer. Such an integrated chamber and nozzle layer structure is commonly referred to as a chamber orifice or chamber nozzle layer.

Although FIG. 3 depicts fluid ejector body 320 separated into three sections, alternate embodiments may utilize any-where from a single section to multiple sections depending on the particular application in which fluid ejector head 300 is utilized. For example, fluid ejector body 320 may have a single section to eject a single fluid. In addition, the fluid chambers formed along longitudinal axis 311 may be in a straight line, staggered configuration, or helical configuration depending on the particular application in which fluid ejector head 300 is utilized. In another example, fluid ejector body 320 includes six sections having straight, staggered, or helical configurations, providing for any of the possible combinations of dispensing multiple fluids.

In addition to having various numbers of sections each section may also be independently optimized for performance. For example, the energy generating elements of each section may be optimized for the particular fluid ejected by that section. In addition, the dimensions of the ejection chambers and nozzles may also be optimized for the particular fluid ejected by that section. Further, energy generating elements as well as chamber and nozzle dimensions within a section may also be varied providing ejection of different drop sizes of the same fluid to be ejected from fluid ejector head 300.

Figure 4:
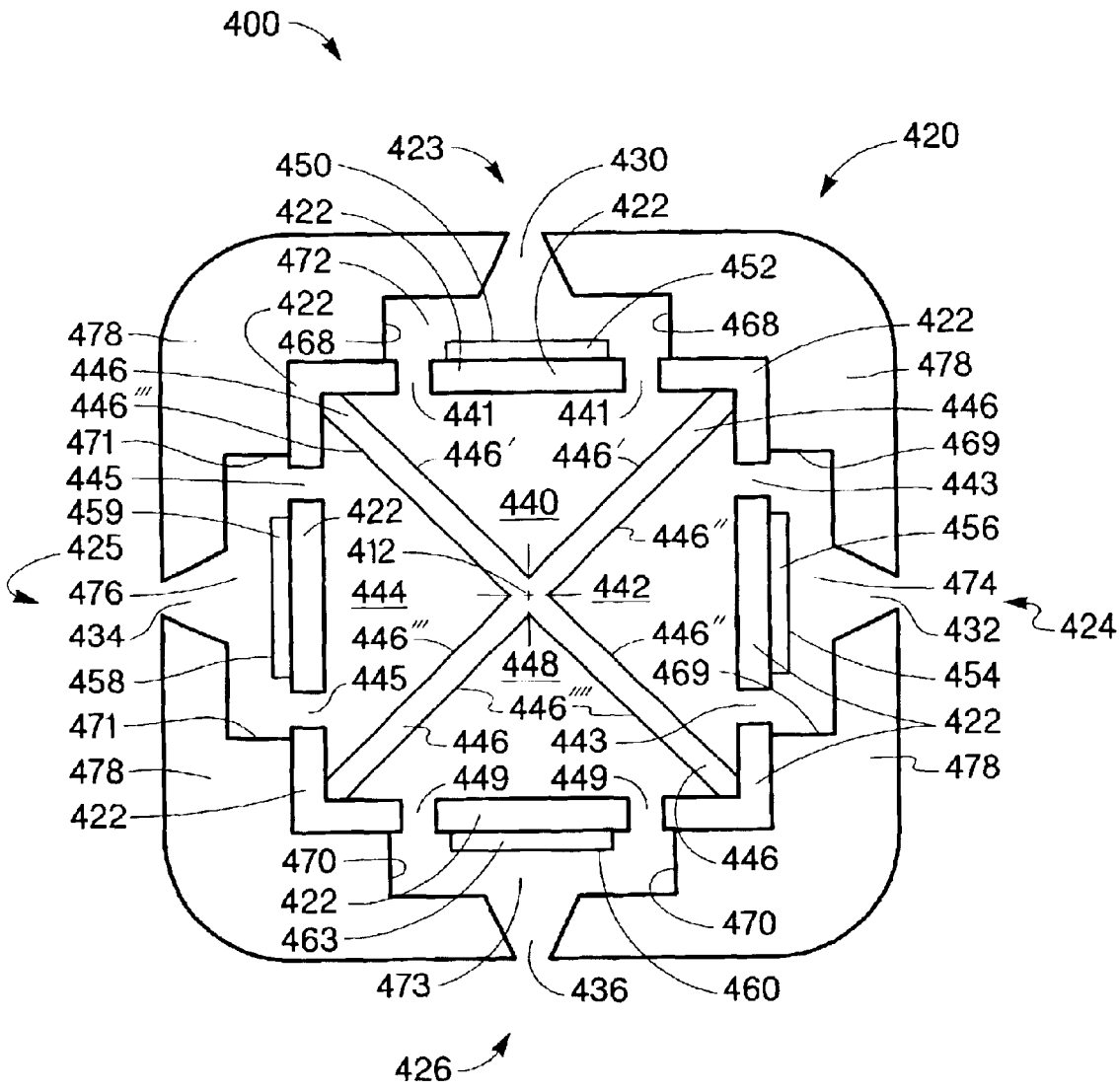
FIG. 4 is a cross-sectional view of a fluid ejector body according to an alternate embodiment of the present invention.

Referring to FIG. 4 an alternate embodiment of a fluid ejector head according to the present invention is shown in a cross-sectional view. In this embodiment, fluid ejector head 400 includes fluid ejector body 420 having a rectangular or square tubular cross-sectional shape, including a longitudinal axis 412 projecting in and out of the cross-sectional view. Fluid ejector head 400 further includes fluid ejector actuator 450, second fluid ejector actuator 454, and third fluid ejector actuator 458 and fourth fluid ejector actuator 460 disposed on fluid ejector body 420. Fluid channel separator 446 is attached to substrate 422 and separates fluid ejector head 400 into four sections: first fluid section 440, second fluid section 424, third fluid section 425, and fourth fluid section 426. For example, four different fluids may be utilized such as a black ink and three color inks. In another example, four different reactive agents may be utilized. In still other examples, various combinations of different fluids such as two different bioactive agents, an ingestible ink and a protective material to cover either the bioactive agents or ink or both may be utilized. In this embodiment, fluid channel 440, is formed by fluid channel separator portions 446' and substrate 422; second fluid channel 442 is formed by fluid channel separator portions 446" and substrate 422; third fluid channel 444 is formed by fluid channel separator portions 446'" and substrate 422; and fourth fluid channel 448 is formed by fluid channel separator portions 446"" and substrate 422.

Fluid inlet channels 441 provide fluidic coupling between fluid channel 440 and fluid ejection chamber 472, and are formed in substrate 422 within fluid section 423; fluid inlet channels 443 provide fluidic coupling between fluid channel 442 and fluid ejection chamber 474; fluid inlet channels 445 provide fluidic coupling between fluid channel 444 and fluid ejection chamber 476; and fluid inlet channels 449 provide fluidic coupling between fluid channel 448 and fluid ejection chamber 473. Fluid energy generating elements 452, 456, 459, and 463 are disposed on substrate 422 and provide the energy impulse utilized to eject fluid from nozzles 430, 432, 434, and 436 respectively. As described in previous embodiments, fluid energy generating elements 452, 456, 459, and 463 may be any element capable of imparting sufficient energy to the fluid to eject it from nozzles.

Chamber orifice layer 478 is disposed over substrate 422 wherein sidewalls 468 define or form a portion of fluid ejection chamber 472; sidewalls 469 form a portion of fluid ejection chamber 474; sidewalls 470 form a portion of fluid ejection chamber 473; and sidewalls 471 form a portion of fluid ejection chamber 476. Chamber orifice layer 478 also includes one or more bores or nozzles 430, 432, 434, and 436 respectively in each section through which fluid is ejected.

Although FIG. 4 depicts fluid ejector body 420 separated into four sections, alternate embodiments, may utilize even more sections depending on the particular application in which fluid ejector head 400 is utilized. For example, fluid ejector body 420 may have five or six sections, or other number of sections, forming a pentagonal or hexagonal, or polygonal shape respectively, providing for any of the various possible combinations of dispensing multiple fluids, depending on the particular application in which fluid ejector head 400 is utilized. As described above the fluid chambers and nozzles formed along longitudinal axis 412 may be in a straight line, or staggered configuration depending on the particular application in which fluid ejector head 400 is utilized. In addition, as also described above, each section as well as chambers, nozzles and energy generating elements may also be independently optimized for performance.

Figure 5:
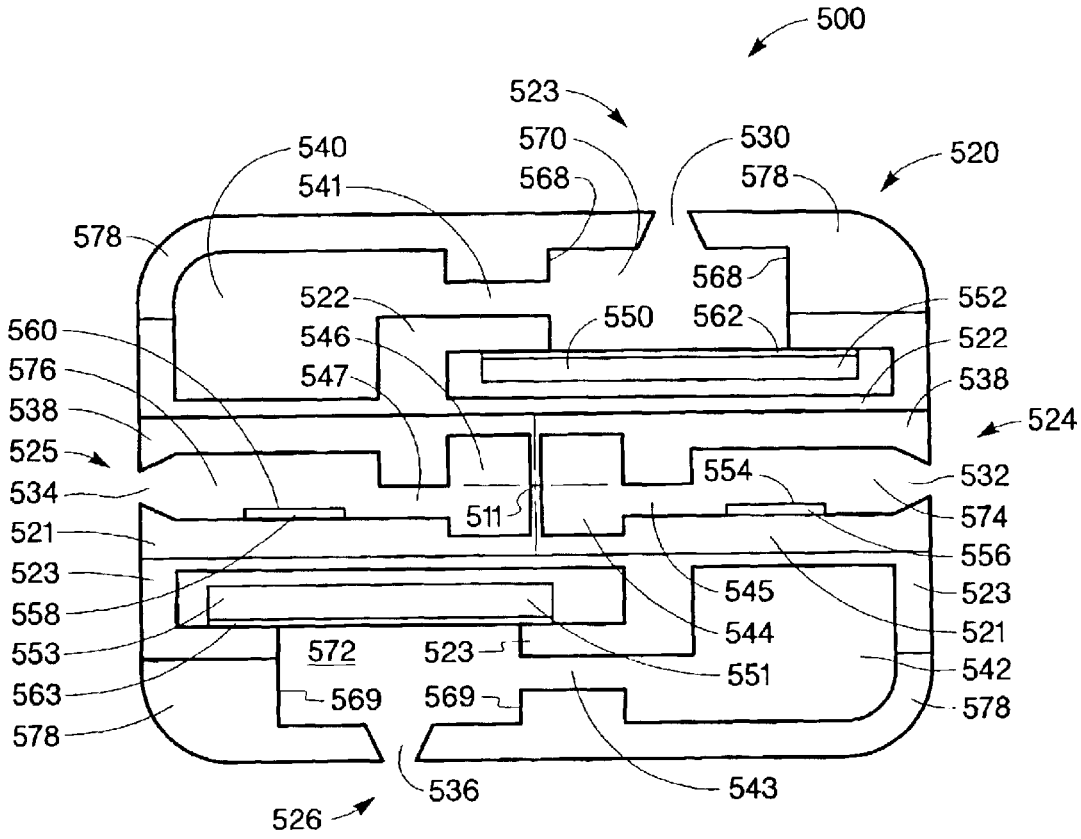
FIG. 5 is a cross-sectional view of a fluid ejector body according to an alternate embodiment of the present invention.

Referring to FIG. 5 an alternate embodiment of a fluid ejector head of the present invention is shown in a cross-sectional view. In this embodiment, fluid ejector head 500 includes fluid ejector body 520 having a rectangular shape, including fluid body longitudinal axis 511 projecting in and out of the cross sectional view. In addition, fluid ejector head 500 includes a combination of different types of fluid ejector actuators. First and second fluid ejector actuators 550 and 551 are of a first type, and third and fourth fluid ejector actuators 554 and 558 are of a second type. In this embodiment, first and second fluid ejector actuators 550 and 551 are piezoelectric transducers 552 and 553, while third and fourth fluid ejector actuators 554 and 558 are thermal resistor energy generating elements 556 and 560 respectively.

Fluid section 523 includes diaphragm 562 attached to substrate 522 and piezoelectric transducer 552, and fluid section 526 includes diaphragm 563 attached to substrate 523 and piezoelectric transducer 553. A voltage pulse applied across either piezoelectric transducer 552 or 553 results in a physical displacement of the piezoelectric transducer and the diaphragm generating a compressive force on the fluid located in either fluid ejection chambers 570 or 572 resulting in ejection of a drop of the fluid from either nozzle 530 or 536. Chamber orifice layer 578 is disposed over substrates 522 and 523 wherein sidewalls 568 and 569 define or form a portion of fluid ejection chambers 570 and 572 respectively. Chamber orifice layer 578 also includes one or more bores or nozzles 530 and 536 through which fluid is ejected. Fluid inlet channels 541 and 543 provide fluidic coupling between fluid channels 540 and 542 and fluid ejection chambers 570 and 572, and are formed between substrate 522 and chamber orifice layer 578 within fluid sections 523 and 526.

Third fluid section 524 and fourth fluid section 525 are formed by substrate 521 and channel top plate 538 of fluid ejector body 520. In addition, substrate 521 and channel top plate 538 form nozzles 532, and 534. These two sections form what are commonly referred to as a "side shooter" configuration, as compared to the "roof shooter" configuration illustrated in FIG. 2. In alternate embodiments, substrate 521 and substrate 523 may be integrated to form a single substrate having different energy generating elements disposed over different portions. In addition, substrate 522 and channel top plate 538 may also be integrated. Third fluid inlet channel 545 provides fluidic coupling between third fluid channel 544 and third fluid ejection chamber 574. Fourth fluid inlet channel 547 provides fluidic coupling between fourth fluid channel 546 and fourth fluid ejection chamber 576. Fluid energy generating elements 556 and 560 are disposed on substrate 521 and provide the energy impulse utilized to eject fluid from nozzles 532 and 536 respectively.

Although the embodiment illustrated in FIG. 5 shows fluid sections 523 and 526 having piezoelectric transducers and fluid sections 524 and 525 having thermal resistors for ejecting a fluid, alternate embodiments may utilize any of combination of energy generating elements described in previous embodiments. Combining thermal resistor "roof shooters" and side shooters in the same fluid ejector head, or combining piezoelectric, and ultrasonic transducers in the same fluid ejector head, are just a couple of examples of combinations of various energy generating elements that may be utilized. In another example, fluid ejector head 500 may contain one section utilizing a compressed air fluid ejector actuator, a second section utilizing piezoelectric fluid energy generating elements, and still third and fourth sections utilizing thermal resistor energy generating elements.

Figure 6A:
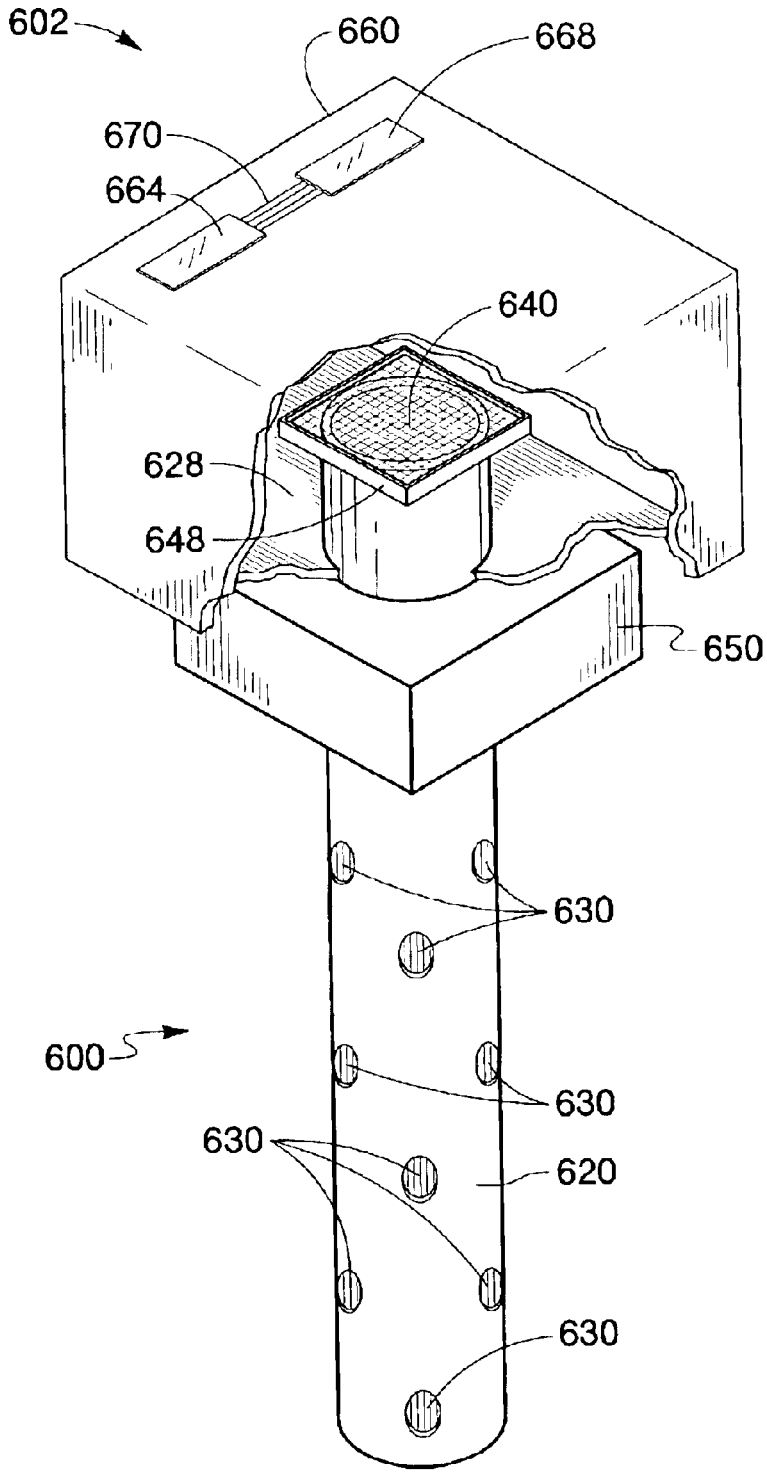
FIG. 6*a* is a perspective view of a fluid ejection cartridge according to an embodiment of the present invention.

Referring to FIG. 6*a* an exemplary embodiment of fluid ejection cartridge 602 of the present invention is shown in a perspective view. In this embodiment, fluid ejection cartridge 602 includes fluid ejector head 600 fluidically coupled to fluid reservoir 628. Fluid ejector body 620 is adapted to be inserted into an enclosing medium opening (not shown). Fluid ejector head 600 further includes nozzles 630 disposed on fluid ejector body 620 and fluidically coupled to fluid channel 640. Fluid contained in fluid reservoir 628 is supplied via filter 648 to fluid channel 640. In addition, fluid ejector actuator 650 is in fluid communication with nozzles 630 so that fluid is ejected from nozzles 630 when fluid ejector actuator is activated. In this embodiment, fluid ejector actuator 650 is electrically coupled to electrical connector 668 via electrical traces or wires (not shown). In alternate embodiments, utilizing, for example, compressed air, fluid ejector actuator 650 may be coupled, to a fluid controller (see FIG. 6*b*), utilizing different connectors such as compressed air fittings and tubing. Fluid ejector head 600 can be any of the fluid ejector heads described in previous embodiments.

Information storage element 664 is disposed on fluid ejection cartridge 602 as shown in FIG. 6*a*. Information storage element 664 is electrically coupled to electrical connector 668. In alternate embodiments information storage element 664 may utilize a separate electrical connector disposed on body 660. Information storage element 664 is any type of memory device suitable for storing and outputting information, to a controller, that may be related to properties or parameters of the fluid or fluid ejector head 600 or both. In this embodiment, information storage element 664 is a memory chip mounted to body 660 and electrically coupled through electrical traces 670 to electrical connector 668. When fluid ejection cartridge 602 is either inserted into, or utilized in, a fluid dispensing system information storage element 664 is electrically coupled to a controller (not shown) that communicates with information storage element 664 to use the information or parameters stored therein.

Figure 6B:
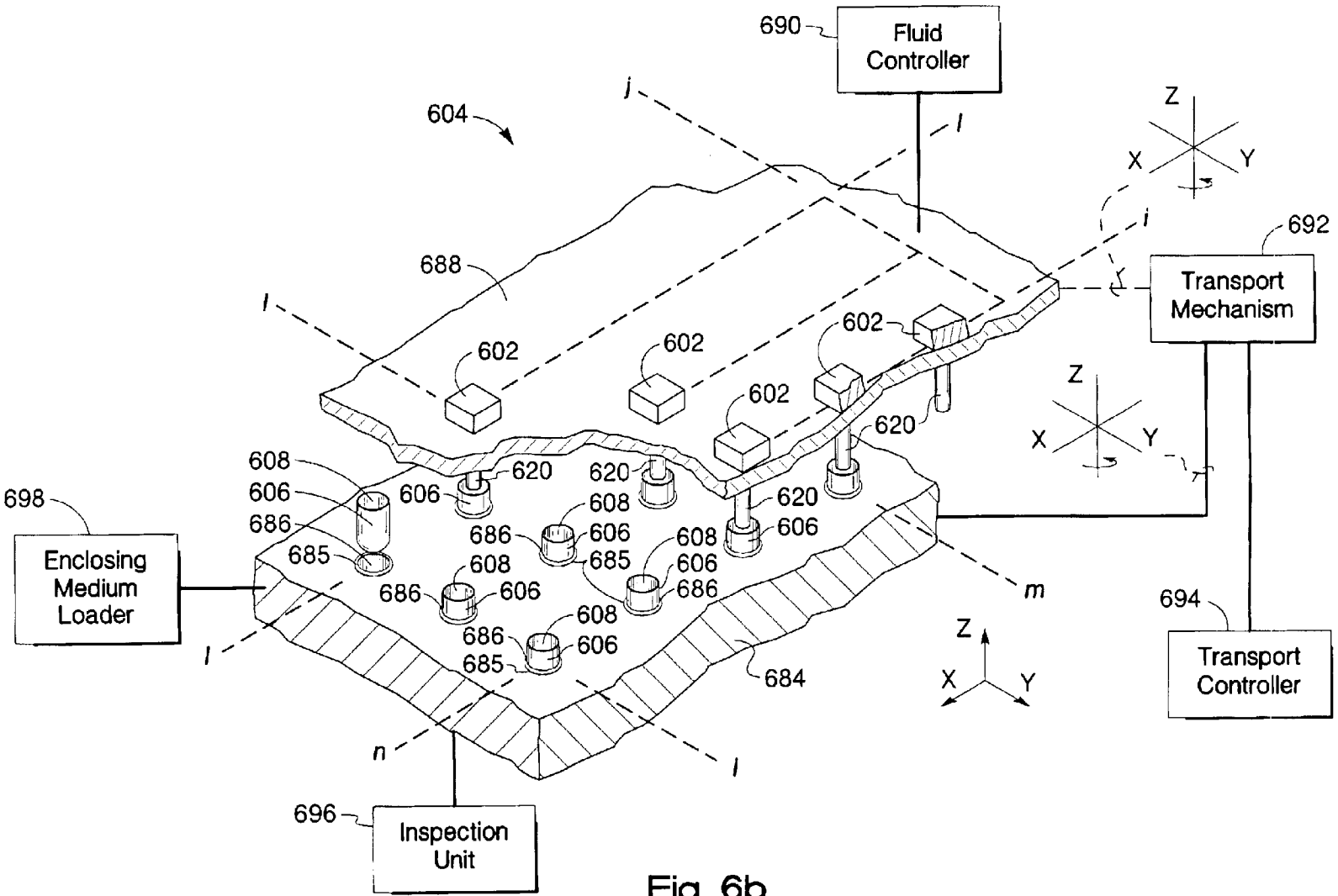
FIG. 6*b* is a perspective view of a fluid dispensing system according to an embodiment of the present invention.

Referring to FIG. 6*b* an exemplary embodiment of fluid dispensing system 604 of the present invention is shown in a perspective view. In this embodiment, fluid dispensing system 604 includes enclosing medium tray 684 having an n×m array of enclosing medium holders 686 adapted to accept insertion of enclosing medium parts 606. Fluid dispensing system 604 further includes an i×j array of fluid ejection cartridges 602 that include fluid ejector bodies 620 adapted to be inserted into enclosing medium openings 608. For example, a system may utilize a tray having a 4×4 array of holders containing enclosing medium parts and a 2×2 array of fluid ejector bodies wherein the tray is effectively divided into four sections of 2×2 holders and the fluid ejector bodies are inserted in the enclosing medium parts in each section. In this embodiment, the array of fluid ejection cartridges 602 is mounted to dispensing bracket 688. Fluid ejector actuators 650 (see FIG. 6*a*) are operably coupled to fluid ejector bodies 620 and fluid controller 690 such that fluid controller 690 activates fluid ejector actuators (see FIG. 6*a*) to eject a fluid onto the interior surface of enclosing medium parts 606. In addition, fluid controller 690 is operably coupled to a rotation mechanism (not shown) disposed on fluid ejection cartridges 602 to rotate fluid ejector bodies 620 about a fluid body longitudinal axis (not shown).

Transport mechanism 692 is coupled to either dispensing bracket 688 or enclosing medium tray 684 or both depending on the particular application in which dispensing system 604 is utilized. Transport mechanism 692 is operably coupled to transport controller 694, and provides signals controlling movement of enclosing medium tray 684 to align enclosing medium openings 608 to fluid ejector bodies 620 as well as insert and withdraw fluid ejector bodies 620 from enclosing medium parts 606. For example, transport mechanism 692 may move enclosing medium tray 684 in X and Y lateral directions while raising and lowering (i.e. movement in the Z direction) dispensing bracket 688 to withdraw and insert fluid ejector bodies 620 into enclosing medium parts 606 as shown in FIG. 6*b*. In alternate embodiments, other combinations of movements may be utilized and controlled by transport mechanism 692 such as rotation of enclosing medium tray 684 about a central axis to provide additional alignment motion. In this embodiment, fluid controller 690 and transport controller 694 may utilize any combination of application specific integrated circuits (ASICs), microprocessors and programmable logic controllers to control the various functions of fluid dispensing system 604. The particular devices utilized will depend on the particular application in which fluid dispensing system 604 is utilized. In addition, dispensing system 604 may optionally include an enclosing medium loader 698 to load enclosing medium parts 606 into enclosing medium holders 686. Further, dispensing system 604 may also include enclosing medium rotator 685 to rotate enclosing medium parts 606 around an enclosing medium longitudinal axis (see FIGS. 1*a* and 1*b*) thus rotate the interior surface of the enclosing medium around the fluid ejector body. Either rotation of enclosing medium parts 606 or rotation of fluid ejector bodies 620 or both can be utilized to generate a two-dimensional array of discrete deposits dispensed onto the interior surface of enclosing medium parts 606.

Optional inspection unit 696 may be utilized to provide in-line, non-destructive quality assurance testing of the manufactured articles. The particular function performed by inspection unit 696 will depend on the particular application in which dispensing system 604 is utilized. For example inspection unit 696 may be utilized to monitor the quantity of material deposited when dispensing bioactive agent on the interior surface of a gelatin capsule. Another example would be monitoring a reaction product when dispensing various reactants on the interior surface of a vial or other suitable container. For example near infrared or other optical techniques may be utilized to perform a rapid in line assay of bioactive agent or agents on enclosing medium parts 606. Further inspection unit 696 may also be utilized to optically monitor the quality of characters generated on the interior surface of a jar, vial or other suitable container.

Figure 7:
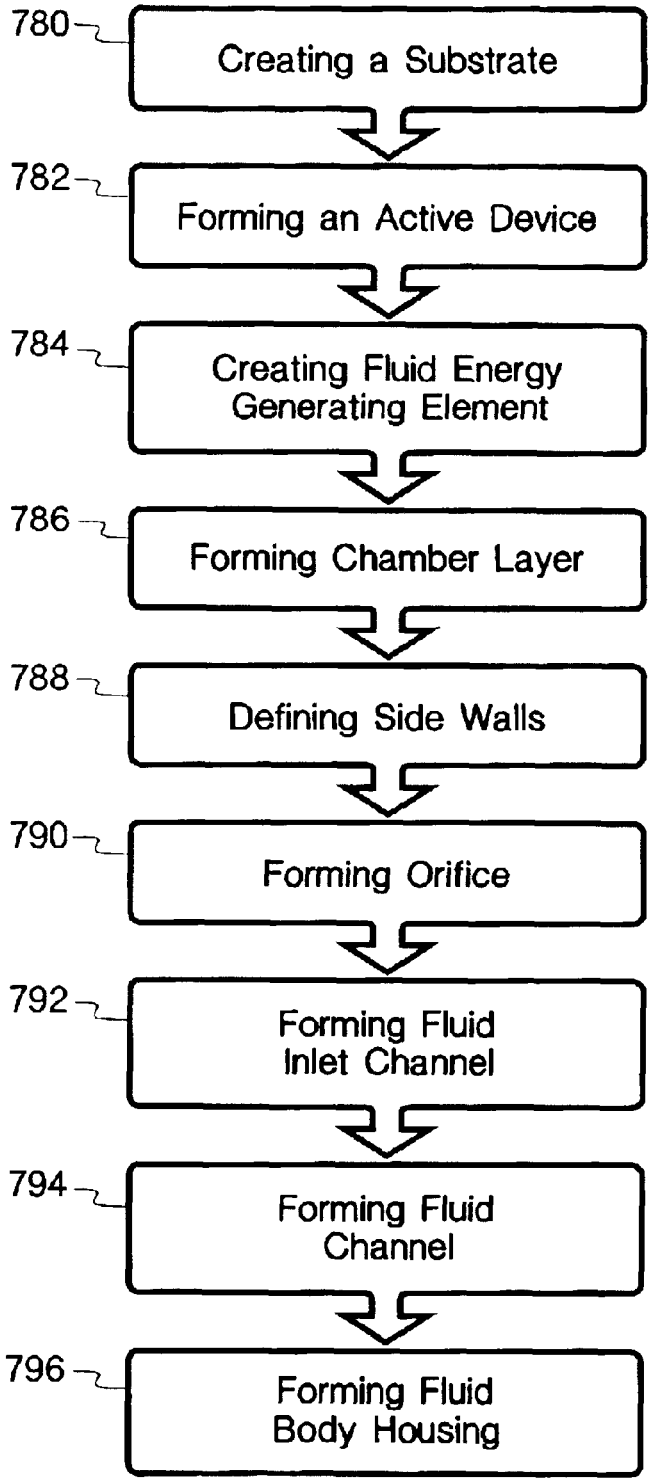
FIG. 7 is a flow diagram of a method of manufacturing a fluid ejector head according to an embodiment of the present invention.

Referring to FIG. 7 a flow diagram of a method of manufacturing a fluid ejector head according to an embodiment of the present invention is shown. Substrate creation process 780 includes making a substrate adapted to be inserted into an opening of an enclosing medium. The substrate may be made from any ceramic, metal, or plastic material capable of forming the appropriate size to fit within the opening of the elongated enclosing. The particular material utilized for the substrate depends on the particular application in which the fluid ejector head will be utilized. For example, if active devices are desirable then substrates having the thermal, chemical, and mechanical properties suitable for semiconductor processing, such as, various glasses, aluminum oxide, polyimide substrates, silicon carbide, and gallium arsenide, to name a few, may be utilized. However, if a "direct drive" is desirable then substrates having less stringent thermal, chemical and mechanical properties can be utilized, such as various plastic materials. Substrate creation process 780 includes forming the substrate in the desired shape, such as cylindrical, rectangular, or other polygonal structures depending on the particular application in which the fluid ejector head will be utilized.

Optional active device forming process 782 utilizes conventional semiconductor processing equipment to form transistors, as well as other logic devices required for the operation of the fluid ejector head, on the substrate. These transistors and other logic devices typically are formed as a stack of thin film layers on the substrate. The particular structure of the transistors is not relevant to the invention, however, various types of solid-state electronic devices may be utilized, such as, metal oxide field effect transistors (MOSFET), or bipolar junction transistors (BJT). As described earlier other substrate materials may also be utilized. Accordingly the substrate materials may also include any of the available semiconductor materials and technologies, such as thin-film-transistor (TFT) technology using polysilicon on glass substrates.

Fluid energy generating element creation process 784 depends on the particular transducer being utilized in the fluid ejector head to create the fluid ejector actuator. Typically, for thermal resistor elements, a resistor is formed as a tantalum aluminum alloy utilizing conventional semiconductor processing equipment, such as sputter deposition systems for forming the resistor and etching and photolithography systems for defining the location and shape of the resistor layer. In alternate embodiments, resistor alloys such as tungsten silicon nitride, or polysilicon may also be utilized. In other alternative embodiments, fluid drop generators other than thermal resistors, such as piezoelectric, or ultrasonic may also be utilized. In still other embodiments, such as those utilizing compressed air the fluid ejector actuator may be created by forming one or more diaphragms in fluid communication with the nozzles. In addition, in those embodiments utilizing active devices formed on the substrate, some of the active devices are, typically, electrically coupled to the fluid energy generating elements by electrical traces formed from aluminum alloys such as aluminum copper silicon commonly used in integrated circuit technology. Other interconnect alloys may also be utilized such as gold, or copper.

Chamber layer forming process 786, depends on the particular material chosen to form the chamber layer, or the chamber orifice layer when an integrated chamber layer and nozzle layer is used. The particular material chosen will depend on parameters such as the fluid being ejected, the expected lifetime of the fluid ejector head, the dimensions of the fluid ejection chamber and fluidic feed channels among others. Generally, conventional photoresist and photolithography processing equipment or conventional circuit board processing equipment is utilized. For example, the processes used to form a photoimagable polyimide chamber layer would be spin coating and soft baking. However, forming a chamber layer, from what is generally referred to as a solder mask, would typically utilize either a coating process or a lamination process to adhere the material to the substrate. Other materials such as silicon oxide or silicon nitride may also be utilized as a chamber layer, using deposition tools such as plasma enhanced chemical vapor deposition or sputtering.

Sidewall definition process 788 typically utilizes photolithography tools for patterning. For example after either a photoimagable polyimide or solder mask has been formed on the substrate, the chamber layer would be exposed through a mask having the desired chamber features. The chamber layer is then taken through a develop process and typically a subsequent final bake process after develop. Other embodiments, may also utilize a technique similar to what is commonly referred to as a lost wax process. In this process, typically a lost wax or sacrificial material that can be removed, through, for example, solubility, etching, heat, photochemical reaction, or other appropriate means, is used to form the fluidic chamber and fluidic channel structures as well as the orifice or bore. Typically, a polymeric material is coated over these structures formed by the lost wax material. The lost wax material is removed by one or a combination of the above-mentioned processes leaving a fluidic chamber, fluidic channel and orifice formed in the coated material.

Nozzle or orifice forming process 790 depends on the particular material chosen to form the nozzle layer. The particular material chosen will depend on parameters such as the fluid being ejected, the expected lifetime of the printhead, the dimensions of the bore, bore shape and bore wall structure among others. Generally, laser ablation may be utilized; however, other techniques such as punching, chemical milling, or micromolding may also be used. The method used to attach the nozzle layer to the chamber layer also depends on the particular materials chosen for the nozzle layer and chamber layer. Generally, the nozzle layer is attached or affixed to the chamber layer using either an adhesive layer sandwiched between the chamber layer and nozzle layer, or by laminating the nozzle layer to the chamber layer with or without an adhesive layer.

As described above (see FIGS. 4–5) some embodiments will utilize an integrated chamber and nozzle layer structure referred to as a chamber orifice or chamber nozzle layer. This layer will generally use some combination of the processes already described depending on the particular material chosen for the integrated layer. For example, in one embodiment a film typically used for the nozzle layer may have both the nozzles and fluid ejection chamber formed within the layer by such techniques as laser ablation or chemical milling. Such a layer can then be secured to the substrate using an adhesive. In an alternate embodiment a photoimagible epoxy can be disposed on the substrate and then using conventional photolithography techniques the chamber layer and nozzles may be formed, for example, by multiple exposures before the developing cycle. In still another embodiment, as described above the lost wax process may also be utilized to form an integrated chamber layer and nozzle layer structure.

Fluid inlet channel forming process 792 depends on the particular material utilized for the substrate. For example to form the fluid inlet channels in a silicon substrate a dry etch may be used when vertical or orthogonal sidewalls are desired. However, when sloping sidewalls are desired a wet etch such as tetra methyl ammonium hydroxide (TMAH) may be utilized. In addition, combinations of wet and dry etch may also be utilized when more complex structures are utilized to form the fluid inlet channels. Other processes such as laser ablation, reactive ion etching, ion milling including focused ion beam patterning, may also be utilized to form the fluid inlet channels depending on the particular substrate material utilized. Micromolding, electroforming, punching, or chemical milling are also examples of techniques that may be utilized depending on the particular substrate material utilized.

Fluid channel forming process 794, typically, will utilize an injection molding process to form the desired shape of the fluid channels depending on the particular application in which the fluid ejector head will be utilized. The injection molded fluid channel would then be mounted, using a suitable adhesive, to either the substrate or a fluid body housing depending on the particular structure being utilized.

Optional fluid body housing forming process 796, typically, will utilize an injection molding process to form the desire shape of the fluid body housing depending on the particular application in which the fluid ejector head will be utilized. In some embodiments, such as that shown in FIGS. 2*a* and 2*b*, fluid body housing forming process 796 and fluid channel forming process 794 may be combined in a single process to form both the fluid body housing and the fluid channels. For example, as shown in FIG. 2*a* attachment of the fluid body housing to the substrate utilizing an appropriate adhesive creates the fluid ejector body adapted to be inserted into the opening of the enclosing medium. In still other embodiments the fluid ejector body is created by the nozzle layer formed on the chamber layer formed on the substrate as illustrated in FIG. 3.

Figure 8:
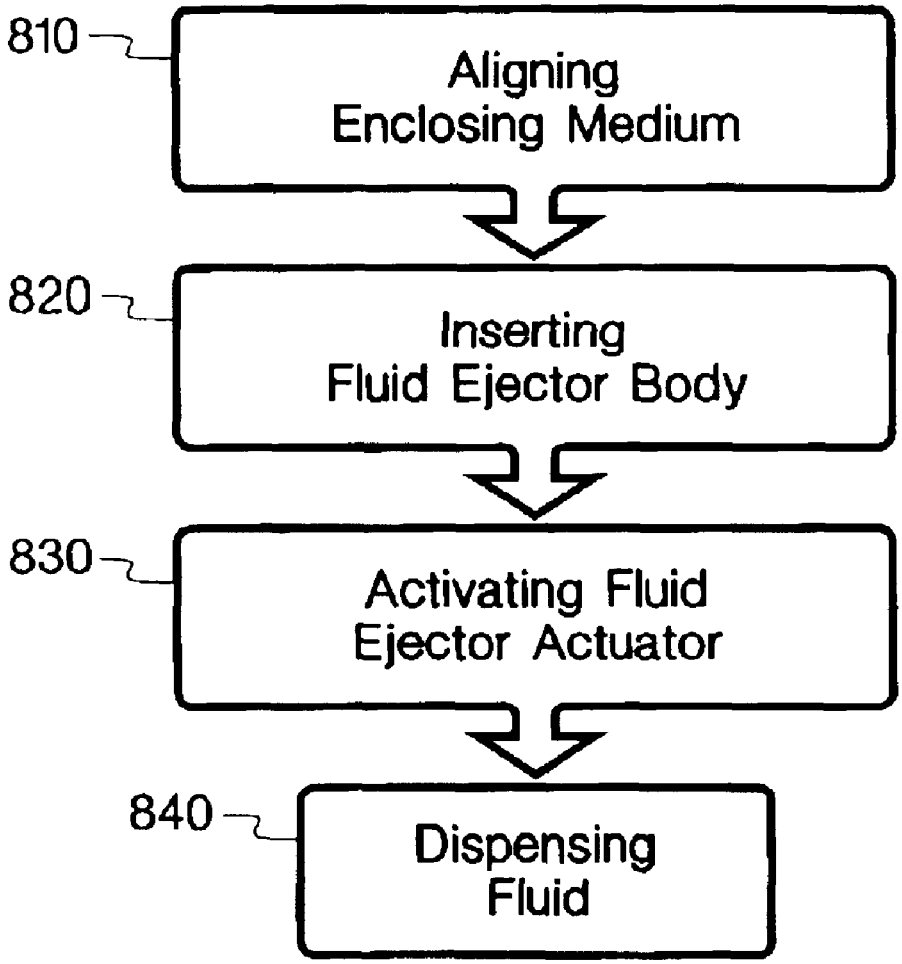
FIG. 8 is a flow diagram of a method of using a fluid dispensing system according to an embodiment of the present invention.

An exemplary embodiment of a method for using a fluid dispensing system to dispense discrete deposits of material onto the interior surface of an enclosing medium is shown as a flow diagram in FIG. 8. Aligning enclosing medium process 810 is used to align the opening in the enclosing medium to the fluid ejector head so that the fluid ejector body may be inserted into the enclosing medium. The enclosing medium is, typically, in an enclosing medium tray or other holding device. The tray or other holding device is under the control of a transport mechanism and the transport controller. Any of the conventional techniques for aligning parts may be utilized. For example, an electric or pneumatic motor or other actuator may move the tray or other holding device in X and Y lateral directions to establish proper alignment of the enclosing medium to the fluid ejector head. In addition, typically a theta or rotational alignment about a Z-axis will also be provided. Further, sensors located on the holding device, or an optical vision system or combination thereof will, typically, be utilized to provide feed back that the enclosing medium is properly aligned to the fluid ejector body. In alternate embodiments, the transport controller may be linked to a fluid ejection cartridge or fluid ejector head, mounted to a dispensing bracket, providing movement of the fluid ejector body or both the fluid ejector body and the holding device to properly align the enclosing medium to the fluid ejector heads.

Inserting fluid ejector body process 820 is utilized to insert the fluid ejector body into the opening of the enclosing medium. The fluid ejector head is typically under the control of fluid ejection cartridge or fluid ejector head position controller or transport mechanism and transport controller. For example, in one embodiment, an electric or pneumatic motor may raise and lower in the Z direction the fluid ejector head providing the movement for inserting the fluid ejector body into the opening of the enclosing medium. In alternate embodiments, the tray, or other holding device or a combination of the tray and the fluid ejector head are moved to insert the fluid ejector head into the opening of the enclosing medium.

Activating fluid ejector actuator process 830 is utilized to eject the fluid from at least one nozzle disposed on the fluid ejector body. Typically, a drop-firing controller or fluid controller in the fluid dispensing system, coupled to the fluid ejector head, activates the fluid ejector actuator, to eject drops of the fluid. For those embodiments, utilizing a fluid energy generating element, such as piezoelectric or thermal resistor elements, the drop firing controller will, typically, activate a plurality of fluid energy generating elements to eject essentially a drop of the fluid each time a fluid energy generating element is activated. Typically the fluid energy generating elements can reproducibly and reliably eject drops in the range of from about five femtoliters to about 10 nanoliters. Such a drop size corresponds to deposits in the picogram to microgram range depending on the ratio of the amount of the desired material to be deposited to the amount of solvent in the fluid drop ejected. However, depending on the particular application in which the fluid dispensing system is utilized, the size of these fluid drops can be controlled, in the range from about 5 femtoliters to about 1 microliter. Such a drop size corresponds to deposits in the picogram to milligram range depending on the ratio of the amount of the desired material to be deposited to the amount of solvent in the fluid drop ejected.

Dispensing fluid process 840 is utilized to dispense and control the location of the ejected fluid drops on the inside surface of the enclosing medium to form the discrete agent deposits. Depending on the particular fluid ejector head utilized, the fluid drops may be ejected through the nozzles along a nozzle ejection axis, at a predetermined ejection angle from a fluid body normal. In one embodiment, the nozzle ejection axis is aligned at an angle between about 0° and about 60° from the fluid body normal. In alternate embodiments, a fluid ejector head having a nozzle ejection axis aligned at an angle between about 0° and about 45° from the fluid body normal may be utilized. Preferably, a fluid ejector head with a nozzle ejection axis substantially perpendicular to a fluid ejector body longitudinal axis is utilized.

In addition, depending on the particular fluid ejector body utilized dispensing fluid process 840 may also include an optional rotational displacement process. The rotational displacement process is utilized, for example, to create rows of the discrete deposits for those embodiments utilizing fluid ejector heads having a single column of nozzles for a particular fluid. By utilizing rotation, dispensing fluid process 840 may generate a two-dimensional array forming an areal density of fluid deposits on the interior surface of the enclosing medium. Three-dimensional arrays may also be generated by dispensing fluid deposits on top of previously dispensed fluid deposits. In addition, for those embodiments utilizing fluid ejector heads having multiple columns of nozzles the rotational displacement may be utilized to form -rows of the discrete deposits having a smaller spacing between deposits than obtained with the same fluid ejector head without rotation. The rotational displacement may be accomplished by any of the conventional techniques utilized for rotation such as electrical or pneumatic motors, or piezoelectric motors to name just a couple of examples. The rotational displacement may be imparted to the enclosing medium, to the fluid ejector body, or some combination thereof.

Dispensing fluid process 840 may also include an optional vertical displace process. The vertical displacement process may be utilized to create columns of the discrete deposits having a smaller spacing between deposits than normally obtained with the same fluid ejector head without vertical displacement. The fluid drop controller typically controls the vertical displacement, however a separate controller may also be utilized. For example, the fluid drop controller may be coupled to the tray position controller or the fluid ejector head controller or both to generate the appropriate vertical displacement. In alternate embodiments, separate controllers and motors or other actuators may be utilized to generate the appropriate vertical displacement. By utilizing various combinations of rotation and vertical displacement various structures may be generated, from simple two-dimensional arrays, or overlapping deposits forming a layer, to more complex structures such as three-dimensional arrays.

Figure 9A:
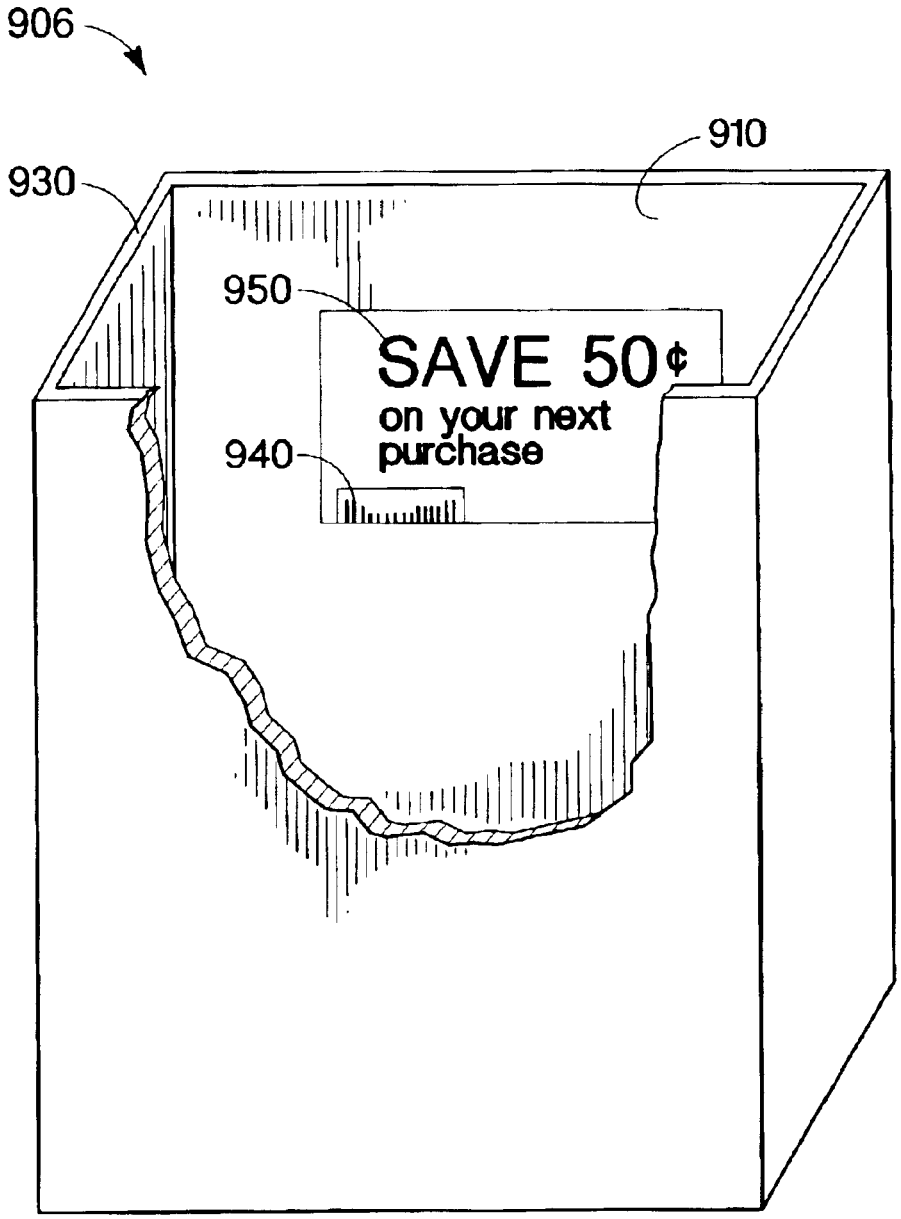
FIG. 9*a* is a perspective view of an article made using an embodiment of the present invention.

Referring to FIG. 9*a* an article of manufacture made using a fluid dispensing system according to an embodiment of the present invention is shown in a perspective view. In this embodiment, enclosing medium 906 is container 930 that has interior surface 910 upon which is printed various alphanumeric characters 950 representing information in a human-perceptible form and bar code 940 representing information in a machine under stood form. Although the information depicted in FIG. 9*a* is what is commonly referred to as a "consumer coupon" alternate embodiments, may include any desirable consumer or manufacturing information. In addition the information can be any symbol, icon, image, or text or combinations thereof, such as a company logo or cartoon character. Other examples of various forms in which the information may be presented are a one-dimensional bar code, a text message, a code, or hologram.

Figure 9B:
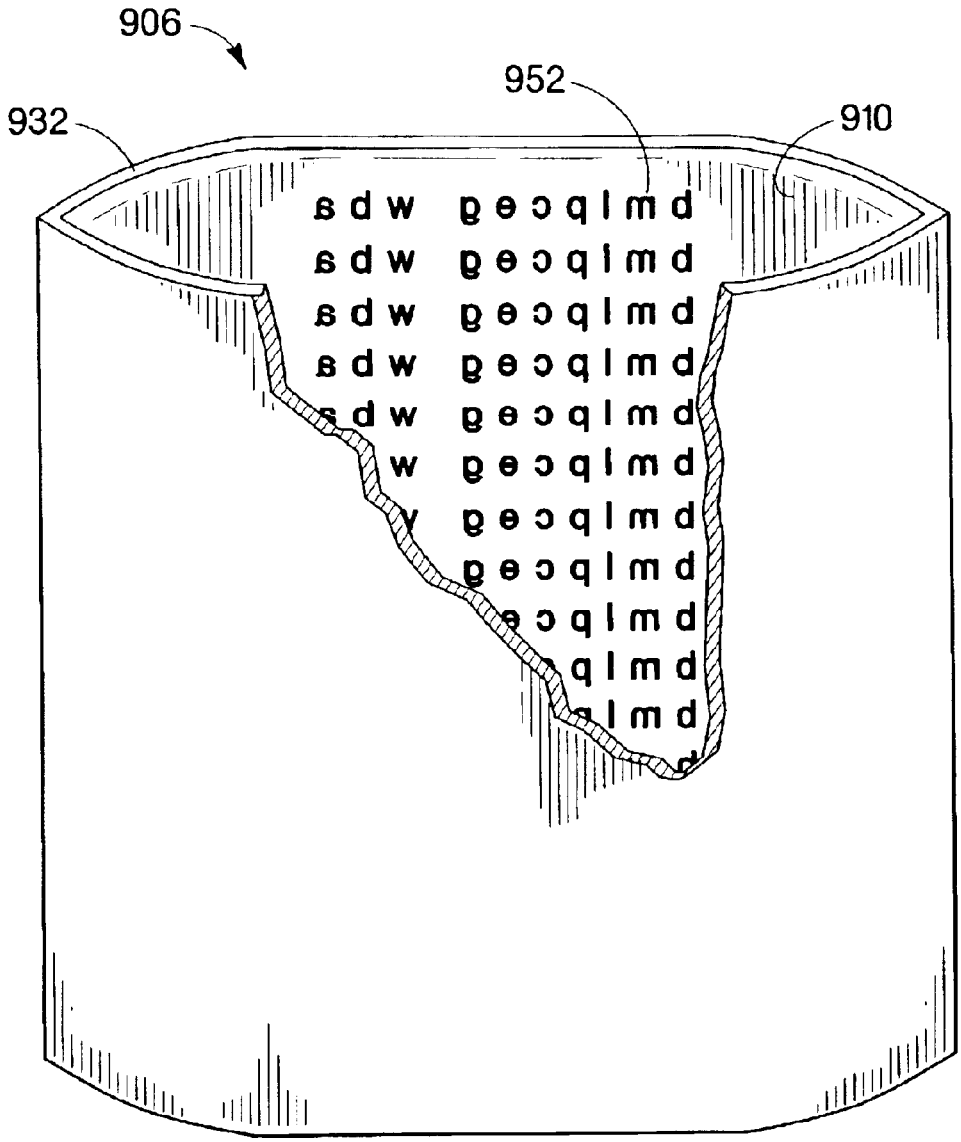
FIG. 9*b* is a perspective view of an article made using an embodiment of the present invention.

Referring to FIG. 9*b* an article of manufacture having a more variable shape may also be made using a fluid dispensing system according to an embodiment of the present invention is shown in a perspective view. In this embodiment, enclosing medium 906 is flexible package 932 that has interior surface 910 upon which is printed, in reverse letters to be legible from the outside, various alphanumeric characters 952. Alphanumeric characters 952 are generated using ink deposits or dots (not shown) that are deposited on interior surface 910 of flexible package 932 in patterns using dot matrix manipulation or other means. As described above in for FIG. 9*a* an image, alphanumeric characters, or a machine understood code such as a one or two-dimensional bar code may be utilized.

Figure 9C:
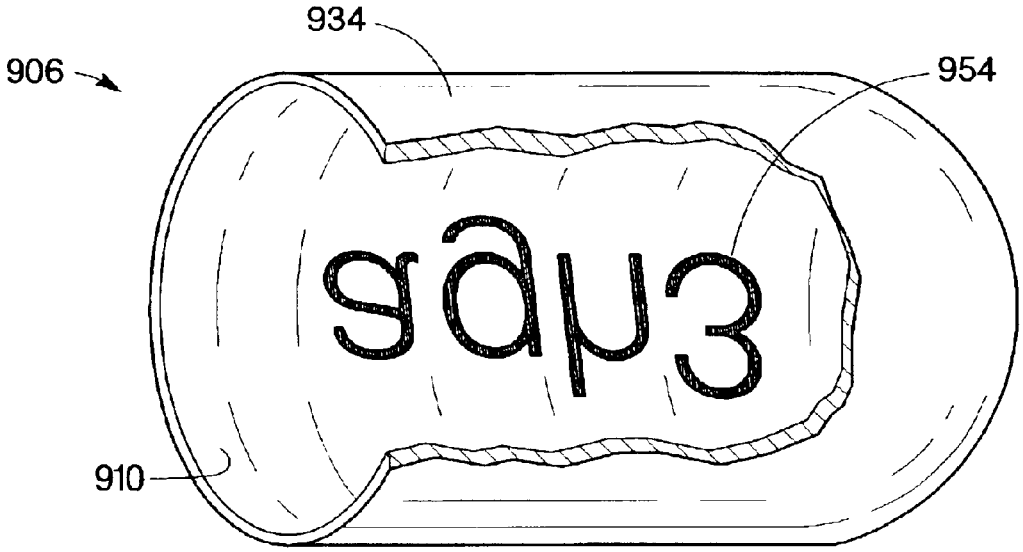
FIG. 9*c* is a perspective view of an article made using an embodiment of the present invention.

Referring to FIG. 9*c* a label made on a gelatin capsule using a fluid dispensing system according to an embodiment of the present invention is shown in a perspective view. In this embodiment, enclosing medium 906 is gelatin capsule 934 that has interior surface 910 upon which is printed, pattern 954 using dot matrix manipulation or other means to generate an image, alphanumeric characters, or a machine understood code. In this embodiment the pattern 954 utilizes discrete ink deposits (not shown) to generate the alphanumeric characters "agh3" printed on the inside of enclosing medium 906 in reverse letters to be legible from the outside. By printing on the inside of enclosing medium 906, such characters or images are not as easily rubbed off or washed off as for conventional packages printed either on the outside surface or on labels subsequently applied to the outer surface of the package.

What is claimed is:

1. A fluid ejector head, comprising:

a fluid ejector body having a cylindrical outer surface, said cylindrical outer surface having a longitudinal axis, said fluid ejector body adapted to be inserted into an opening of an enclosing medium, said enclosing medium having an interior surface, wherein said cylindrical outer surface conforms to said interior surface;

at least one nozzle disposed on said fluid ejector body; and a drop-on-demand fluid ejector actuator in fluid communication with said at least one nozzle, wherein activation of said fluid ejector actuator ejects a fluid through said at least one nozzle onto a predetermined location on said interior surface of said enclosing medium.

2. The fluid ejector head in accordance with claim 1, wherein said drop-on demand fluid ejector actuator, for each activation, ejects essentially a drop of said fluid onto said interior surface of said enclosing medium.

3. The fluid ejector head in accordance with claim 2, wherein said enclosing medium further comprises a side interior surface and a bottom interior surface and essentially said drop of said fluid is ejected onto said side interior surface of said enclosing medium.

4. The fluid ejector head in accordance with claim 2, further comprising at least one active device disposed on said fluid ejector body electrically coupled to said fluid ejector actuator.

5. The fluid ejector head in accordance with claim 4, wherein said at least one active device further comprises at least one transistor.

6. The fluid ejector head in accordance with claim 2, wherein the volume of the fluid, of essentially said drop, is in the range of from about 5 femtoliters to about ten nanoliters.

7. The fluid ejector head in accordance with claim 2, wherein the volume of the fluid, of essentially said drop, is in the range of from about 5 femtoliters to about one microliters.

8. The fluid ejector head in accordance with claim 1, further comprising a fluid channel fluidically coupled to said at least one nozzle.

9. The fluid ejector head in accordance with claim 1, further comprising:

at least one second fluid nozzle disposed on said fluid ejector body;

a second fluid channel fluidically coupled to said at least one second fluid nozzle; and a second fluid ejector actuator in fluid communication with said at least one second fluid nozzle, wherein activation of said second fluid ejector actuator ejects a second fluid onto said interior surface of said enclosing medium.

10. The fluid ejector head in accordance with claim 9, wherein said drop-on-demand fluid ejector actuator, for each activation, essentially a drop of a second fluid onto said interior surface of said enclosing medium.

11. The fluid ejector head in accordance with claim 1, further comprising:

at least one third fluid nozzle disposed on said fluid ejector body;

a third fluid channel fluidically coupled to said at least one third fluid nozzle; and a third fluid ejector actuator in fluid communication with said at least one third fluid nozzle, wherein activation of said third fluid ejector actuator ejects a third fluid material onto said interior surface of said enclosing medium.

12. The fluid ejector head in accordance with claim 11, wherein said drop-on-demand fluid ejector actuator, for each activation, essentially a drop of a third fluid material onto said interior surface of said enclosing medium.

13. The fluid ejector head in accordance with claim 1, wherein said fluid ejector body is rotatable within said enclosing medium.

14. The fluid ejector head in accordance with claim 1, further comprising a fluid body housing having a portion adapted to be insertable within the opening of said enclosing medium, and said fluid body housing enclosing a portion of said fluid ejector body.

15. The fluid ejector head in accordance with claim 1, wherein said fluid ejector actuator ejects said fluid in a substantially radial direction onto said interior surface of said enclosing medium.

16. The fluid ejector head in accordance with claim 1, wherein said enclosing medium further comprises a longitudinal axis, and said fluid ejector actuator ejects said fluid in a direction substantially perpendicular to said longitudinal axis onto said interior surface of said enclosing medium.

17. The fluid ejector head in accordance with claim 1, wherein said at least one nozzle further comprises a nozzle ejection axis and said fluid ejector body further comprises a fluid body longitudinal axis, wherein said fluid body longitudinal axis and said nozzle ejection axis form a predetermined ejection angle.

18. The fluid ejector head in accordance with claim 17, wherein said predetermined angle is in the range from about minus sixty degrees to plus sixty degrees about a fluid body normal of said fluid body.

19. The fluid ejector head in accordance with claim 17, wherein said predetermined angle is in the range from about minus forty five degrees to plus forty five degrees about a fluid body normal of said fluid body.

20. The fluid ejector head in accordance with claim 17, wherein said fluid body longitudinal axis is substantially perpendicular to said nozzle ejection axis.

21. The fluid ejector head in accordance with claim 1, further comprising multiple nozzles in a staggered configuration.

22. The fluid ejector head in accordance with claim 1, further comprising multiple nozzles in a helical configuration.

23. The fluid ejector head in accordance with claim 22, wherein said multiple nozzles form a single helix.

24. The fluid ejector head in accordance with claim 1, further comprising multiple nozzles in a straight configuration.

25. The fluid ejector head in accordance with claim 1, further comprising a second fluid ejector actuator wherein said fluid ejector actuator is of a first type and said second fluid ejector actuator is of a second type.

26. The fluid ejector head in accordance with claim 1, wherein said fluid ejector actuator ejects a fluid through said at least one nozzle onto a predetermined location on a side interior surface of said enclosing medium.

27. A fluid ejection cartridge comprising:

a fluid ejector head in accordance with claim 1; and a fluid reservoir containing said fluid, and fluidically coupled to said fluid ejector head.

28. The fluid ejection cartridge in accordance with claim 27, further comprising an information storage element coupled to a controller having at least one parameter of said fluid that is communicable to said controller.

29. The fluid ejection cartridge in accordance with claim 28, wherein said information storage element further comprises at least one parameter of the fluid ejector head that is communicable to said controller.

30. A fluid dispensing system comprising:

at least one fluid ejection cartridge of claim 27;

a fluid controller operably coupled to said fluid ejector actuator; and at least one enclosing medium holder adapted to hold said enclosing medium, wherein said fluid controller activates said fluid ejector actuator to eject a fluid onto said interior surface of said enclosing medium.

31. The fluid dispensing system in accordance with claim 30, further comprising an i×j array of fluid ejection cartridges disposed on a dispersing bracket, and wherein said at least one enclosing medium holder further comprises an enclosing medium tray having an n×m array of enclosing medium holders disposed thereon, wherein i, j, m, and integers.

32. The fluid dispensing system in accordance with claim 30, wherein said enclosing medium holder and said fluid controller cooperate to dispense said fluid in a two-dimensional array onto said interior surface of said enclosing medium.

33. The fluid dispensing system in accordance with claim 30, wherein said enclosing medium holder and said fluid controller cooperate to dispense said fluid in a two-dimensional array onto said interior surface of said enclosing medium.

34. The fluid dispensing system in accordance with claim 30, further comprising a transport mechanism coupled to said at least one enclosing medium holder providing movement to said at least one enclosing medium holder.

35. The fluid dispensing system in accordance with claim 34, further comprising a transport controller operably coupled to said transport mechanism providing signals to control movement of said at least one enclosing medium holder in three mutually orthogonal directions.

36. The fluid dispensing system in accordance with claim 35, wherein said transport controller provides a rotational signal to said transport mechanism to rotate an enclosing medium tray about a central axis.

37. The fluid dispensing system in accordance with claim 34, further comprising a dispensing bracket, wherein said fluid ejector body is mounted to said dispensing bracket and said transport mechanism is coupled to said dispensing bracket.

38. The fluid dispensing system in accordance with claim 34, wherein said transport mechanism provides movement to said fluid ejector body to insert said fluid ejector body into said enclosing medium.

39. The fluid dispensing system in accordance with claim 30, further comprising an inspection unit providing in-line non-destructive testing of said enclosing medium.

40. A method of using a fluid dispensing system, comprising:

inserting a fluid ejector body having a cylindrical outer surface into an opening of an enclosing medium, said cylindrical outer surface having a longitudinal axis, and said enclosing medium having an interior surface, wherein said cylindrical outer surface conforms to said interior surface;

activating a drop-on-demand fluid ejector actuator to eject a fluid; and dispensing said fluid at pre-selected locations onto at least a portion of said interior surface of said enclosing medium.

41. The method in accordance with the method of claim 40, wherein activating said drop on demand fluid ejector actuator further comprises ejecting essentially a drop of said fluid, and wherein dispensing said fluid further comprises dispensing said fluid in a two dimensional array of discrete deposits on said interior surface of said enclosing medium.

42. A container manufactured in accordance with the method of claim 41.

43. The method in accordance with the method of claim 41, wherein ejecting essentially said drop of said fluid further comprises ejecting essentially said drop having a volume in the range of from about five femtoliters to about one microliters.

44. The method in accordance with the method of claim 41, wherein ejecting essentially said drop of said fluid further comprises ejecting essentially said drop having a volume in the range of from about five femtoliters to about ten nanoliters.

45. The method in accordance with the method of claim 40, wherein activating said fluid ejector actuator further comprises ejecting said fluid in a predetermined angle to a fluid body normal of said fluid ejector body.

46. The method in accordance with the method of claim 45, wherein said predetermined angle is in the range from about minus sixty degrees to plus sixty degrees about a fluid body normal of said fluid ejector body.

47. The method in accordance with the method of claim 45, wherein said predetermined angle is in the range from about minus forty five degrees to plus forty five degrees about a fluid body normal of said fluid ejector body.

48. The method in accordance with the method of claim 40, further comprising printing manufacturing information onto said enclosing medium.

49. The method in accordance with the method of claim 48, wherein said printing further comprises printing said manufacturing information onto said enclosing medium in a machine understood form.

50. The method in accordance with the method of claim 48, wherein said printing further comprises printing said manufacturing information onto said enclosing medium in a human readable form.

51. The method in accordance with the method of claim 40, further comprising aligning said enclosing medium to said fluid ejector body.

52. The method in accordance with the method of claim 51, wherein aligning said enclosing medium further comprises rotating an enclosing medium tray.

53. The method in accordance with the method of claim 52, further comprising moving said enclosing medium tray in a lateral direction.

54. The method in accordance with the method of claim 40, further comprises rotating said enclosing medium around said fluid ejector body.

55. The method in accordance with the method of claim 40, further comprises rotating said fluid ejector body within said enclosing medium.

56. The method in accordance with the method claim 40, further comprising printing consumer information onto said enclosing medium.

57. The method in accordance with the method of claim 40, wherein said enclosing medium is selected from the group consisting of a container, a vial, a capsule, and a bag.

58. A container manufactured in accordance with the method claim 40.

59. The method in accordance with the method of claim 40, wherein said fluid includes a solid component, and wherein dispensing said fluid further comprises dispensing said fluid in discrete deposit, wherein said solid component of said discrete deposit weighs in the range from about one picogram to about one microgram.

60. The method in accordance with the method of claim 59, wherein said solid component of said discrete deposit weighs in the range from about one picogram to about one milligram.

* * * * *

UNITED STATES PATENT AND TRADEMARK OFFICE

CERTIFICATE OF CORRECTION

PATENT NO. : 6,786,591 B2
DATED : September 7, 2004
INVENTOR(S) : Dunfield et al.

It is certified that error appears in the above-identified patent and that said Letters Patent is hereby corrected as shown below:

Title page,
Item [75], Inventor, delete "James W. Ayers," and insert therefor -- James W. Ayres, --.

Column 16,
Line 13, delete "predetermined" and insert therefor -- pre-selected --.

Column 18,
Line 26, delete "two-" and insert therefor -- three- --.

Signed and Sealed this

Twenty-ninth Day of March, 2005

JON W. DUDAS
*Director of the United States Patent and Trademark Office*